US008266817B2

(12) United States Patent
Shih

(10) Patent No.: US 8,266,817 B2
(45) Date of Patent: Sep. 18, 2012

(54) ELECTRIC WOOD KILN

(75) Inventor: Chiang-Shan Shih, Tung An Tsun (TW)

(73) Assignee: Cheng Tai Feng Timber Co., Ltd, Chang Hua Hsien (TW)

( * ) Notice: Subject to any disclaimer, the term of this patent is extended or adjusted under 35 U.S.C. 154(b) by 235 days.

(21) Appl. No.: 12/873,264

(22) Filed: Aug. 31, 2010

(65) Prior Publication Data

US 2012/0048842 A1 Mar. 1, 2012

(51) Int. Cl.
*F26B 21/06* (2006.01)

(52) U.S. Cl. ..... 34/215; 219/400

(58) Field of Classification Search ..... 34/191, 34/209, 210, 215, 218; 219/399, 400
See application file for complete search history.

(56) References Cited

U.S. PATENT DOCUMENTS 5,276,980 A * 1/1994 Carter et al. ..... 34/191
5,526,583 A * 6/1996 Hull et al. ..... 34/491
* cited by examiner

*Primary Examiner* — Charles Garber
*Assistant Examiner* — Reema Patel

(57) ABSTRACT

An electric wood kiln has a containment space sealed by at least one door. A tray is disposed on a bottom base of the electric wood kiln in the containment space. A diversion device is disposed on a top side of the electric wood kiln having a fan set, a plurality of diversion fins, at least one counterflow space and at least one intake aperture. The fan set has fan blades fluidly connected to the counterflow space, and the counterflow space is fluidly connected to the cycling channel on the door and the rear sidewall. An outer region of each fan blade fluidly couples with radial diversion fins; the diversion fins and the counterflow space form fluidly separated spaces coupled via the fan blades, and the intake aperture is connected externally to the electric wood kiln and the counterflow space. A heating device is disposed on a top side of the electric wood kiln adjacent to an outer side of the diversion fins and fluidly connected to the fan set. An adjustable knob is respectively disposed on at least two facing sidewalls of the electric wood kiln. A controller is disposed external to the electric wood kiln and electrically connected to the tray, the fan set, the heating device and the adjustable knob.

5 Claims, 10 Drawing Sheets

ELECTRIC WOOD KILN

BACKGROUND OF THE INVENTION

1. Field of the Invention

The present invention relates to an electric wood kiln, and more particularly to an electric wood kiln capable of providing an even temperature distribution.

2. Description of the Related Art

Currently, a prior art electric wood kiln 60, as shown in FIG. 10, has a controller 70 installed at its top, a vent 61, and a heater 80 disposed at a bottom of the vent 61. The heater 80 utilizes a heating element. The electric wood kiln 60 further comprises a containment chamber 62 and a venting aperture 63 between the containment chamber 62 and the heater 80. Moreover, the containment chamber 62 has a moveable frame 90, and the top and bottom of the movable frame 90 are both rotatably secured. The top of the movable frame 90 is connected to a driving chain 91, and the driving chain 91 is driven by a motor 92. A plurality of aeration panels 64 are disposed around the movable frame 90. In operation, air passes through the vent 61 and the venting aperture 63 to enter into the containment chamber 62 and passes through the heater 80 to be heated, and then the heated air enters through the bottom of the containment chamber 62 and exits through the top of the containment chamber 62. The movable frame 90 is loaded with wood and rotates for an even heating effect. However, the prior art structure has some drawbacks: the air can only enter from the bottom of the containment chamber 62 and be directly vented from the top of the containment chamber 62, therefore, some area in the containment chamber 62 might have relative higher temperatures. Moreover, without temperature information, even the movable frame 90 provides rotations to even the heat distribution, the temperature distribution is still not even enough.

Therefore, it is desirable to provide an electric wood kiln to mitigate and/or obviate the aforementioned problems.

SUMMARY OF THE INVENTION

An objective of the present invention is to provide an electric wood kiln.

In order to achieve the above-mentioned objectives, an electric wood kiln comprises a tray, a diversion device, a heating device, an adjustable knob and a controller. The electric wood kiln has a containment space, the containment space capable of being sealed by at least one door, the door and an opposite rear sidewall both being attached to at least one aeration panel to format least one cycling channel, the electric wood kiln respectively having at least one ventilation panel on two facing side walls to form at least one diversion channel. The tray is disposed on a bottom base of the electric wood kiln and in the containment space. The diversion device is disposed on a top side of the electric wood kiln, the diversion device comprising a fan set, a plurality of diversion fins, at least one counterflow space and at least one intake aperture. The fan set has a plurality of fan blades fluidly connected to the counterflow space. The counterflow space is fluidly connected to the cycling channel on the door and the rear sidewall, an outer region of each fan blade fluidly coupling with a plurality of radial diversion fins. The diversion fins and the counterflow space form fluidly separated spaces coupled via the fan blades, and the intake aperture is connected between the outside of the electric wood kiln and the counterflow space. The heating device is disposed on a top side of the electric wood kiln adjacent to an outer side of the diversion fins and fluidly connected to the fan set. The adjustable knob is respectively disposed on at least two facing sidewalls of the electric wood kiln. The controller is disposed external to the electric wood kiln and capable of electrically connecting the tray, the fan set, the heating device and the adjustable knob.

The controller can be used for setting the rotation speed of the fan set of the diversion device and the heating temperature of the heating device; with the containment space, the cycled thermal air is provided to the electric wood kiln. Furthermore, the controller receives the temperature signals from the temperature sensing units to determine the heating state of the electric wood kiln. If the temperature distribution in the containment space is not even, the controller is capable of controlling the respective adjustable knob to rotate the rotation plate such that the push rod drives the adjusting sheet to guide the heated air from the heating device along different flowing angles, which can improve the temperature distribution in the electric wood kiln.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
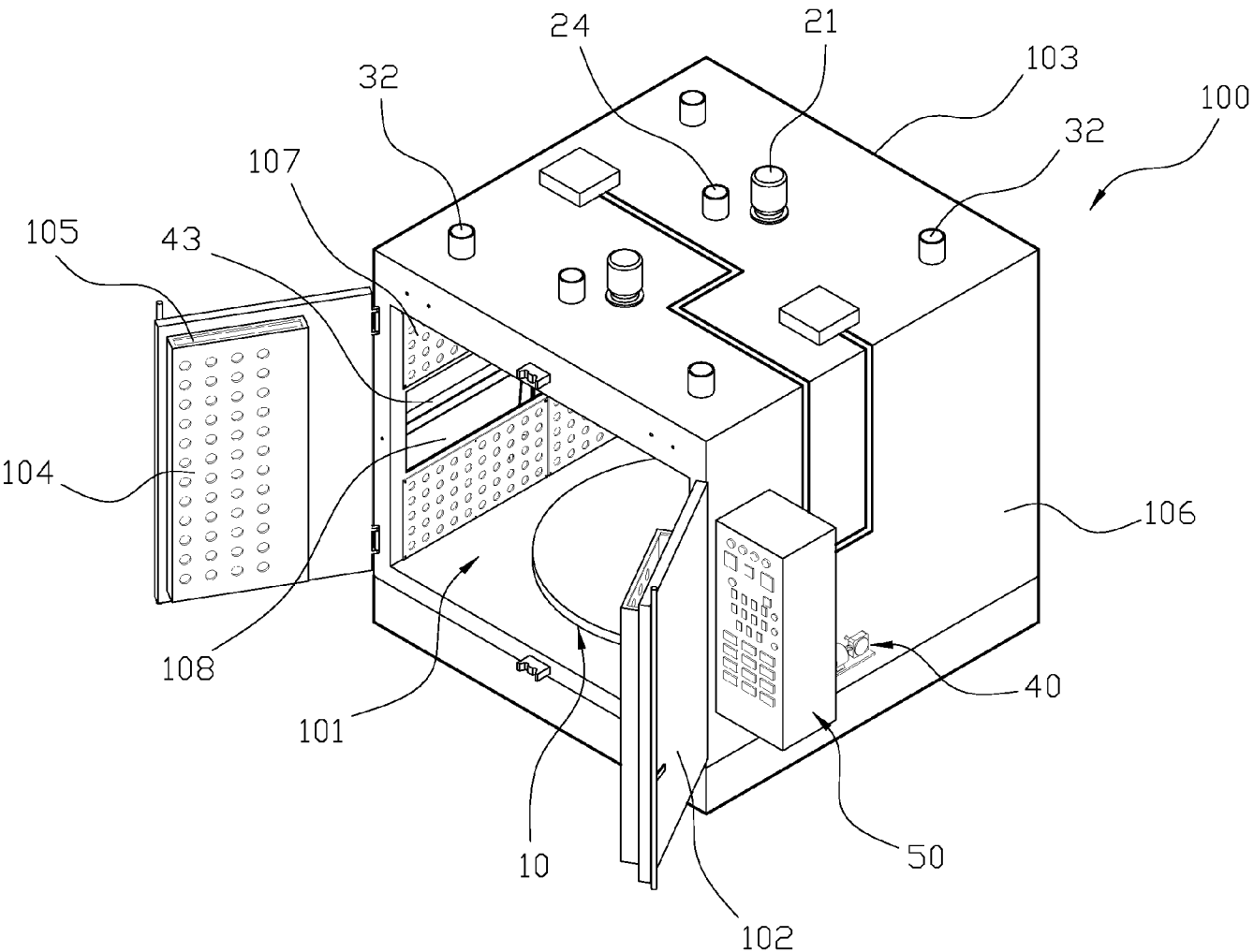
FIG. 1 is a perspective view of an embodiment of the present invention.

Please refer to FIG. 1 to FIG. 4. An electric wood kiln comprises: a tray 10, a diversion device 20, a heating device 30, an adjustable knob 40 and a controller 50. The electric wood kiln 100 has a containment space 101, and the containment space 101 is capable of being sealed by two doors 102. Each door 102 and an opposite rear sidewall 103 are both attached to an aeration panel 104 to form a cycling channel 105. The electric wood kiln 100 has a ventilation panel 107 on each of two facing side walls 106 to form a plurality of diversion channels 108. The tray 10 is disposed on a bottom base of the electric wood kiln 100 and within the containment space 101. The diversion device 20 is disposed on a top side of the electric wood kiln 100, and the diversion device 20 comprises a fan set 21, a plurality of diversion fins 22, a plurality of counterflow spaces 23 and a plurality of intake apertures 24. The fan set 21 has a plurality of fan blades 211 facing downwardly and fluidly connected to the counterflow space 23. The counterflow spaces 23 are fluidly connected to the cycling channel 105 of the doors 102 and the rear sidewall 103. The outer ring of each fan blade 211 is fluidly coupled with a plurality of radial diversion fins 22. The diversion fins 22 and the counterflow space 23 are form different, fluidly separated spaces, and the intake aperture 24 is connected between the region exterior to the electric wood kiln 100 and the counterflow space 23. The heating device 30 is disposed on a top side of the electric wood kiln 100 adjacent to two outer sides of the diversion fins 22 and fluidly connected to the fan set 21. The heating device 30 utilizes a heating element, and the heating element is secured within a ceramic rod 31. The heating device 30 is connected to a plurality of vents 32 coming out of the electric wood kiln 100, which is used for improving the ventilation cycle and to provide cooling for the heating device 30. An adjustable knob 40 is respectively disposed on the two facing sidewalls 106 of the electric wood kiln 100 and each comprises a rotation plate 41 and a push rod 42 extending into the diversion channel 108. One end of each push rod 42 is pivoted onto one end of an adjusting sheet 43 along a middle position of the diversion channel 108. The controller 50 is disposed external to the electric wood kiln 100 and electrically connects the tray 10, the fan set 21, the heating device 30 and the adjustable knobs 40. The controller 50 is also electrically connected to a plurality of temperature sensing units 51, and the temperature sensing units 51 are disposed in the electric wood kiln 100 and used for sensing a respective temperature of each corner of the electric wood kiln 100.

Figure 2:
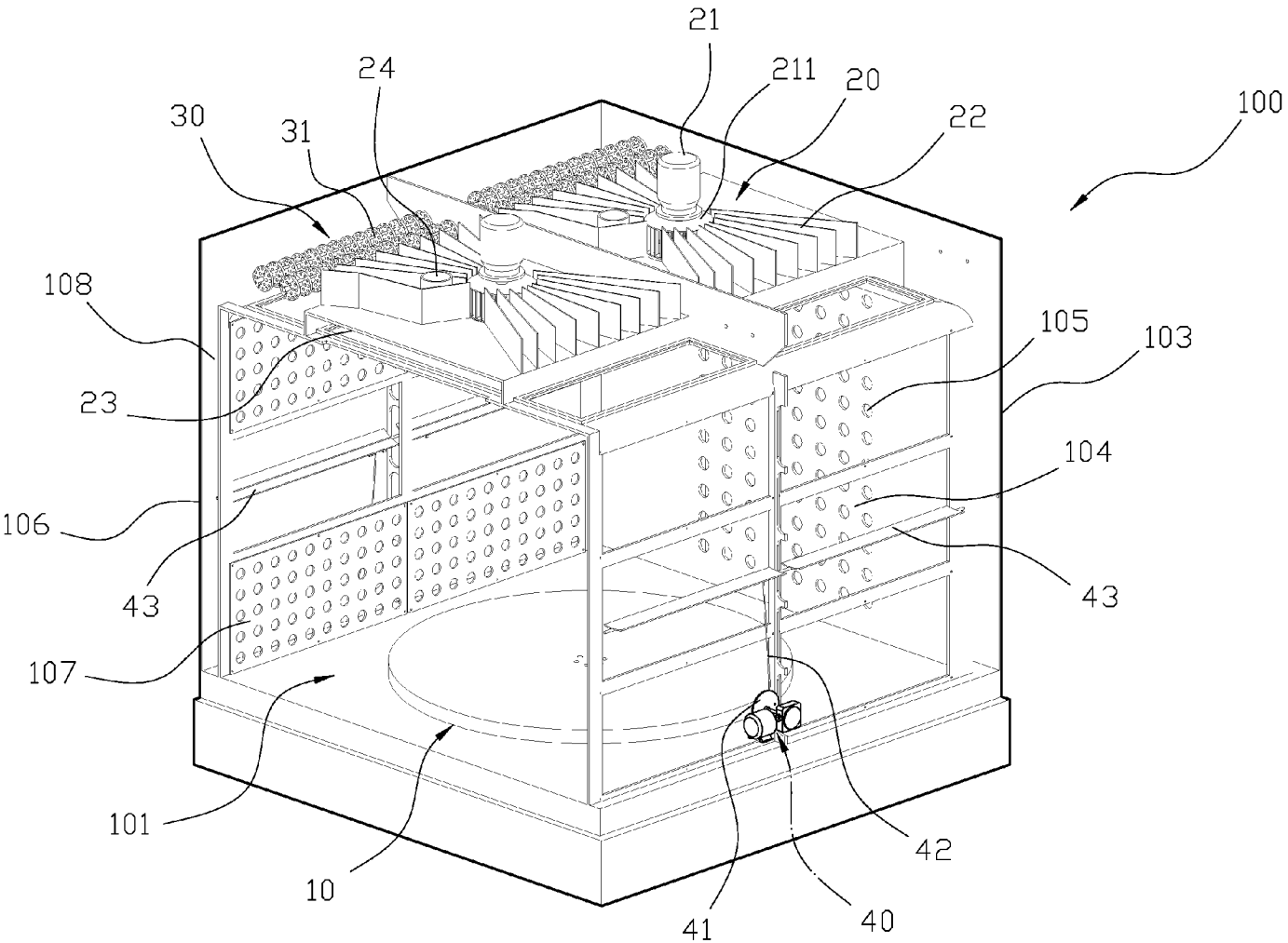
FIG. 2 is an internal structure view of an embodiment of the present invention.
Figure 5:
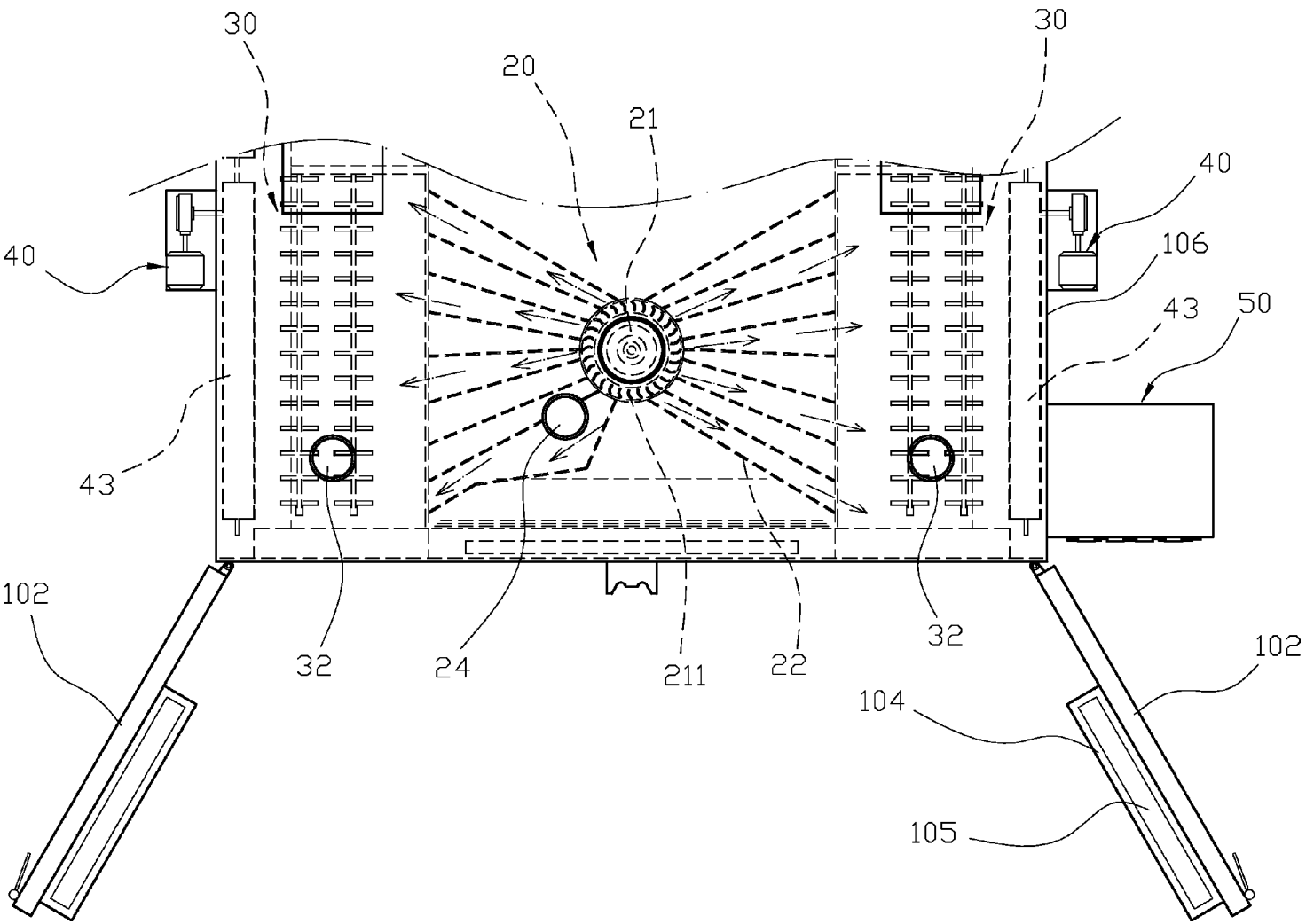
FIG. 5 is a schematic drawing of air flow being guided through diversion fins according to an embodiment of the present invention.
Figure 6:
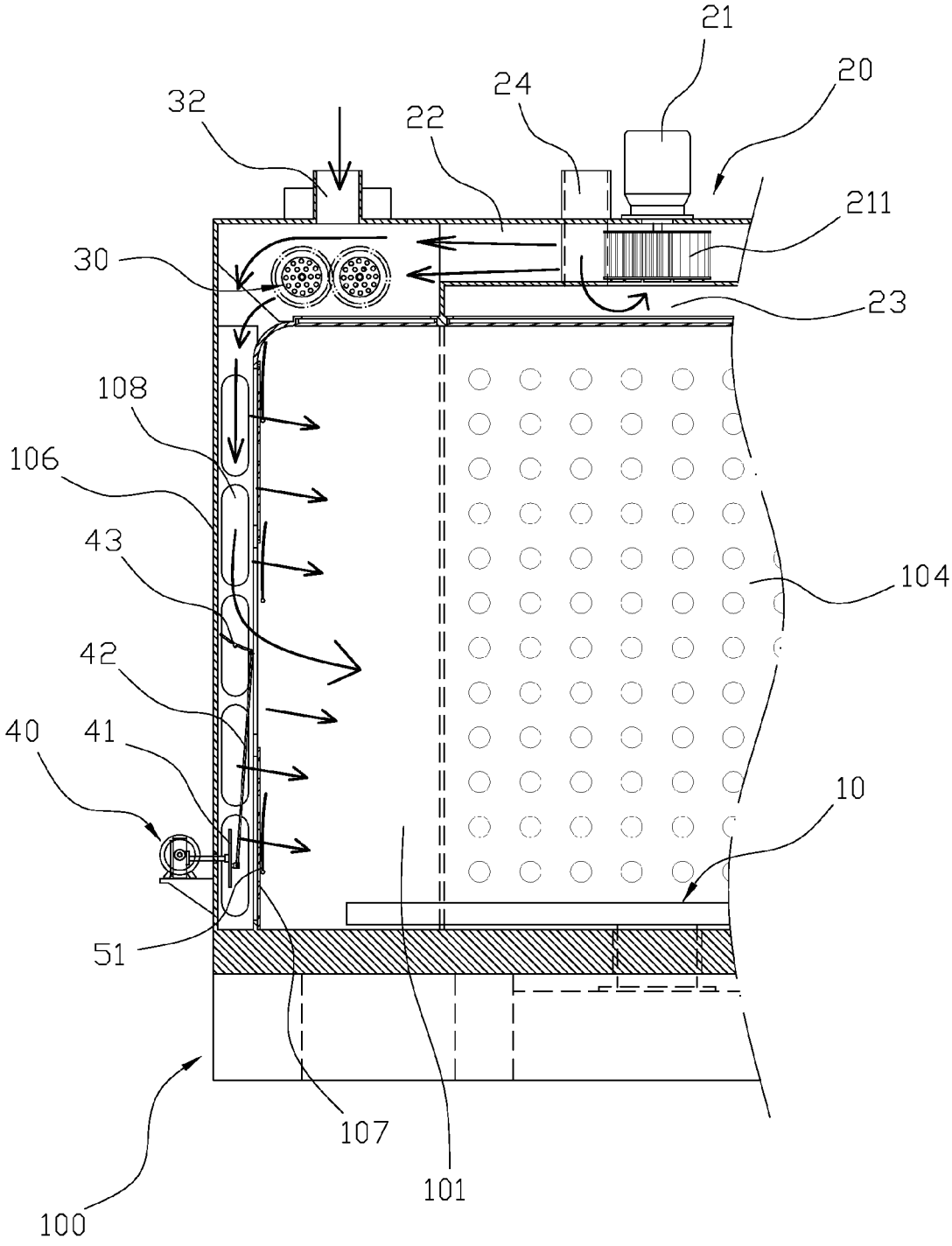
FIG. 6 is a front cross-sectional view of a heating cycle of an embodiment of the present invention.
Figure 7:
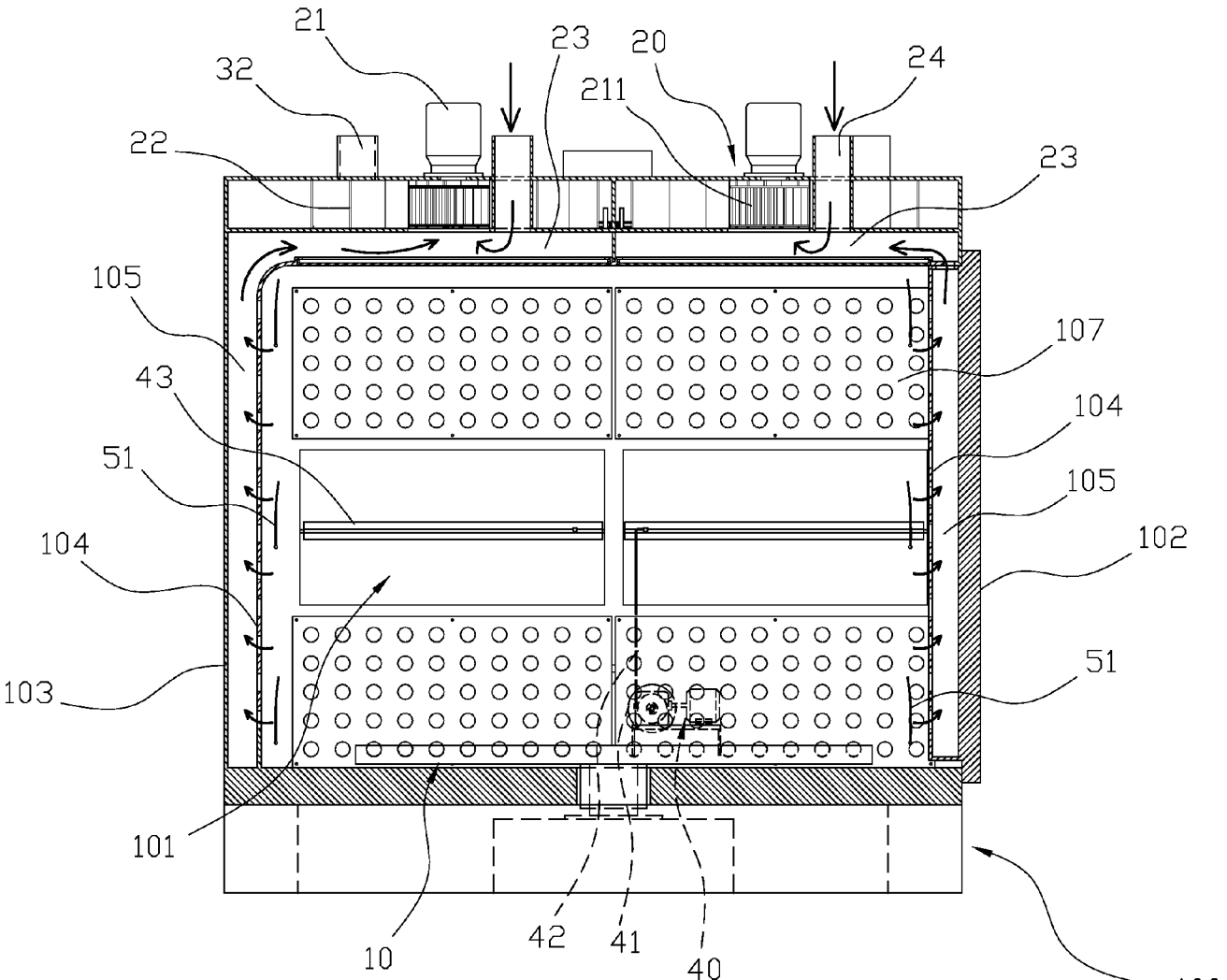
FIG. 7 is a side cross-sectional view of a heating cycle of an embodiment of the present invention.

For actual operations, please refer to FIG. 5 with reference to FIG. 1 and FIG. 2. Wood is placed on the tray 10 in the containment space 101 of the electric wood kiln 100, and the doors 102 are closed to form a closed space. When the controller 50 is turned on for a heating process, the diversion device 20 activates the fan blades 211 of the fan set 21 to obtain air from the counterflow space 23. With external air provided by the intake hole 24, the air obtained from the fan blades 211 is evenly blown out through the diversion fins 22 onto the heating device 30. Please refer to FIG. 6. The heating device generates a high temperature by the high electrical resistance of the heating element, and the generated heat is distributed by the airflow. Furthermore, the direction of the airflow causes the vent pipe 32 to generate suction, which brings in external air through the vent 32. Meanwhile, the hot airflow flows from the top of the electric wood kiln 100 to the sidewalls 106, through the diversion channel 108 and the ventilation panels 107 to enter into the containment space 101 to heat the wood. With the rotation of the tray 10, the wood is heated along various directions. Moreover, the plurality of temperature sensing units 51 in the containment space 101 generate temperature feedback such that the controller 50 can display and adjust the temperature of the heating process. Please refer to FIG. 7. After the wood is heated, the cooler air is vented toward the door 102 and the rear sidewall 103 of the electric wood kiln 100 and passes through the aeration panel 104 to enter into the cycling channel 105 and move along the cycling channel 105 up into the counterflow space 23. Then, the air in the counterflow space 23 is sucked into the fan blades 211 again to complete the cycle and also to be partially exhausted by way of the intake hole 24 to maintain a pressure balance in the containment space 101. The ventilating pipe 32 for the heating device 30 can bring in external air and release extra heat from the heating device 30 to prevent the heating device 30 from overheating.

Figure 3:
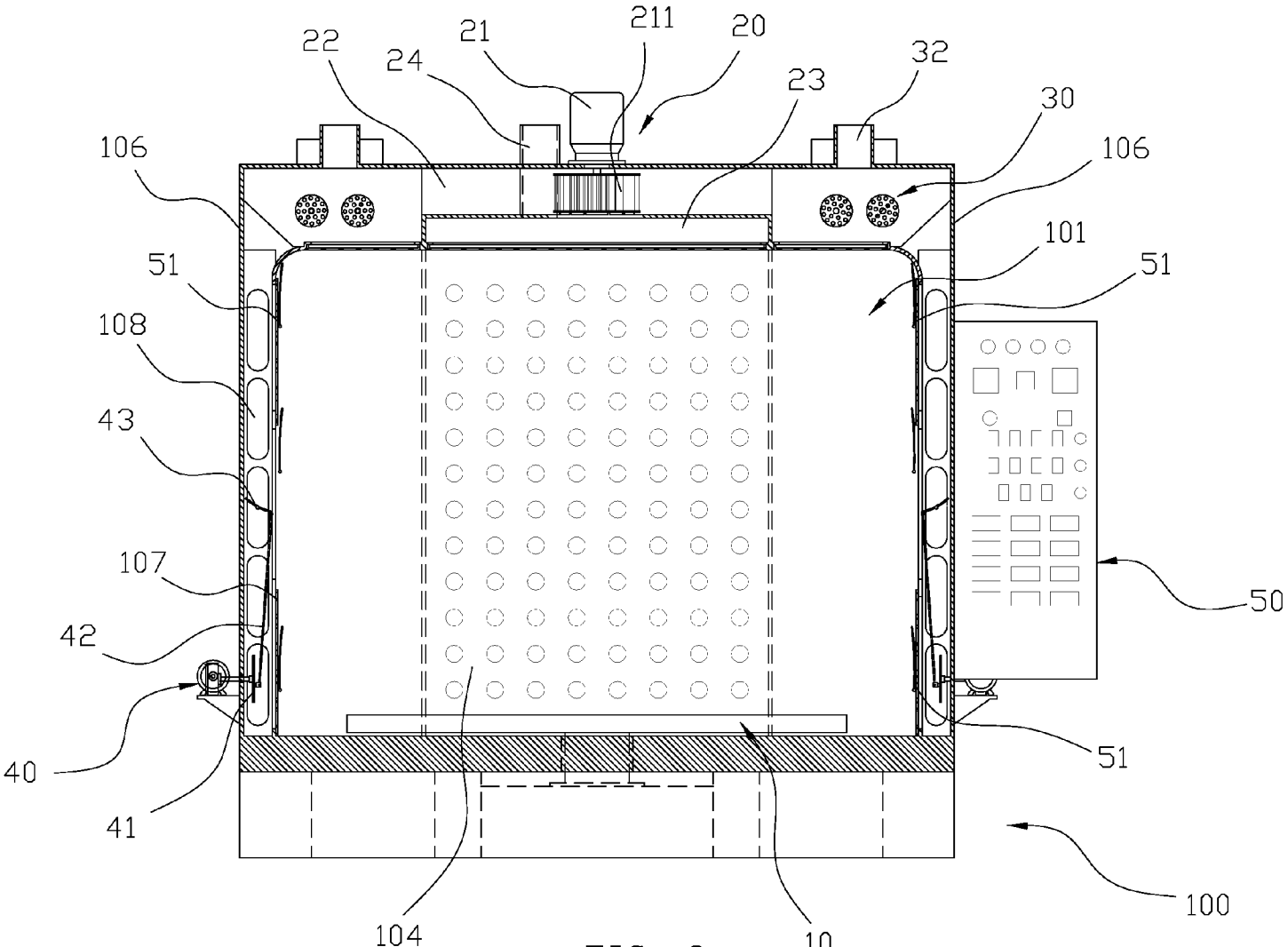
FIG. 3 is a front cross-sectional view of an embodiment of the present invention.
Figure 4:
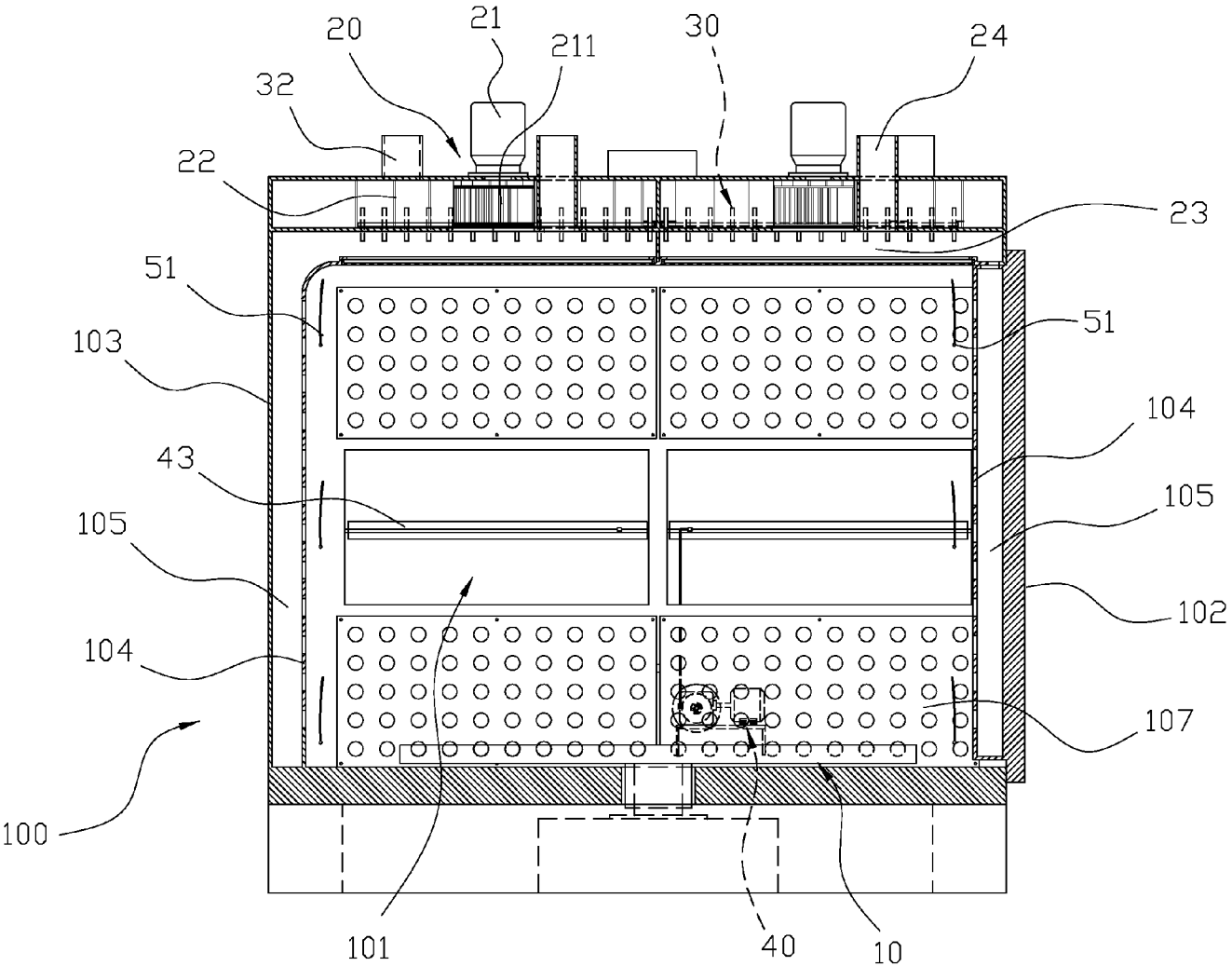
FIG. 4 is a side cross-sectional view of an embodiment of the present invention.
Figure 8:
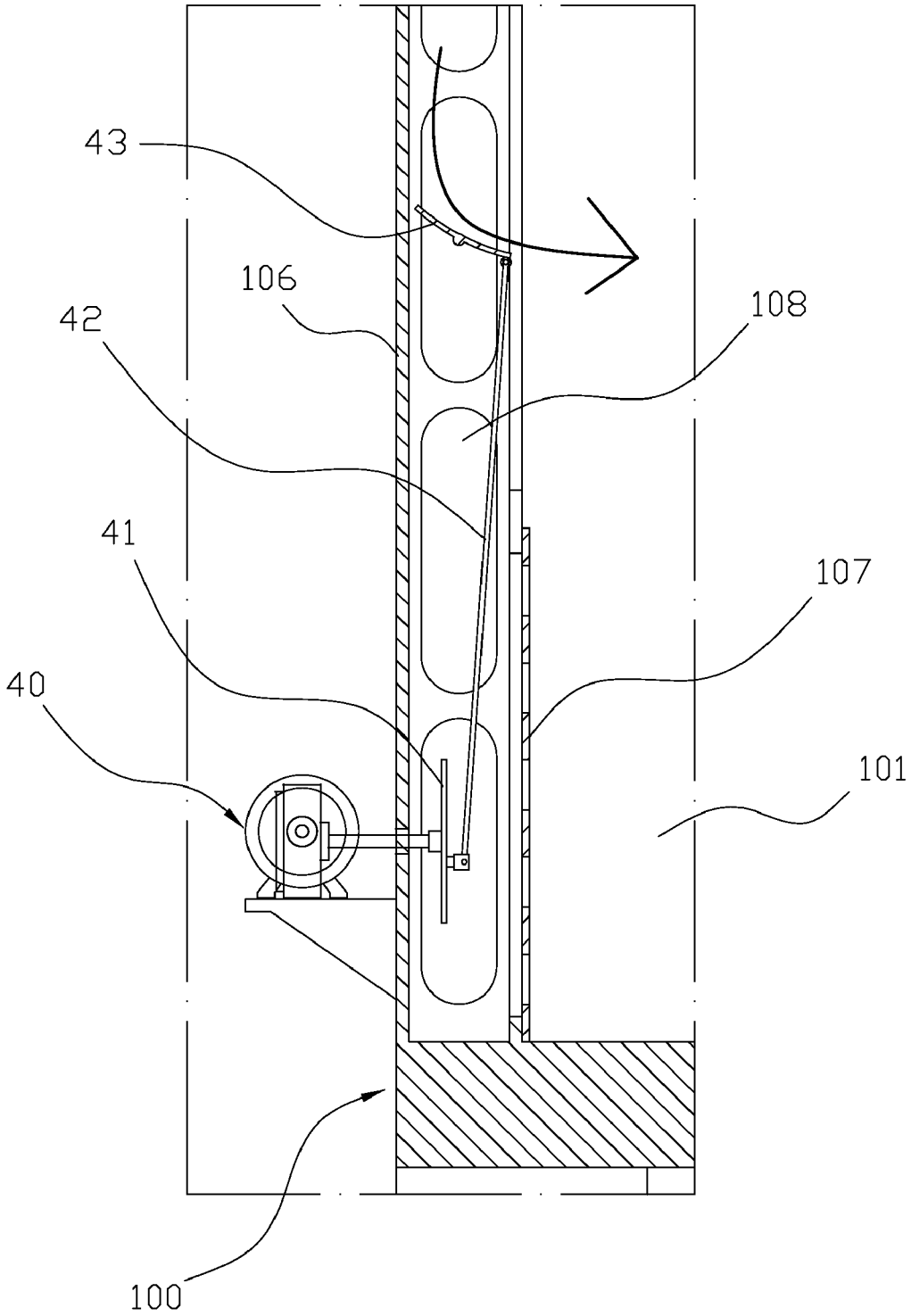
FIG. 8 is a schematic drawing illustrating movements of an adjustable knob according to an embodiment of the present invention.
Figure 9:
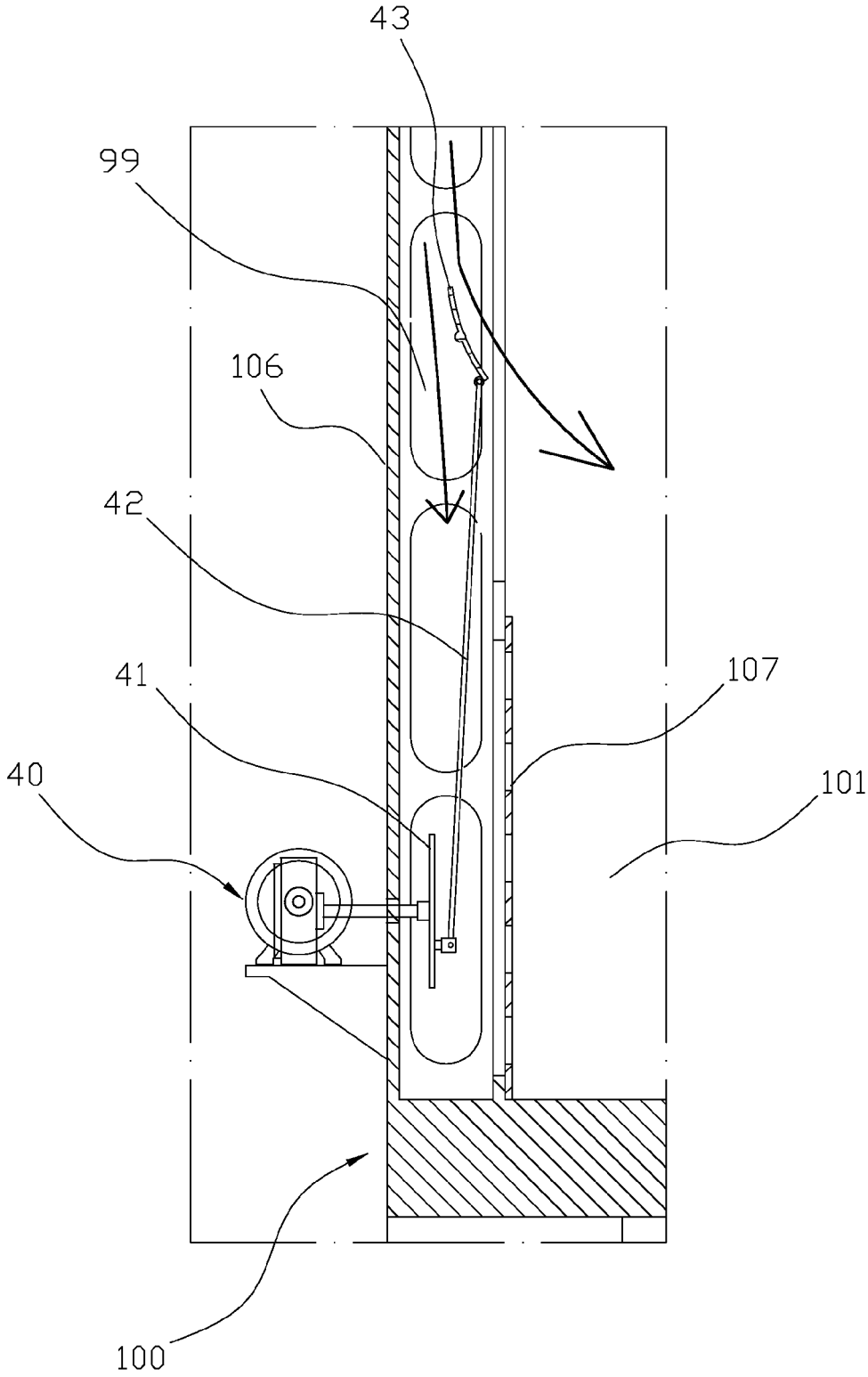
FIG. 9 is another schematic drawing of movements of an adjustable knob according to an embodiment of the present invention.
Figure 10:
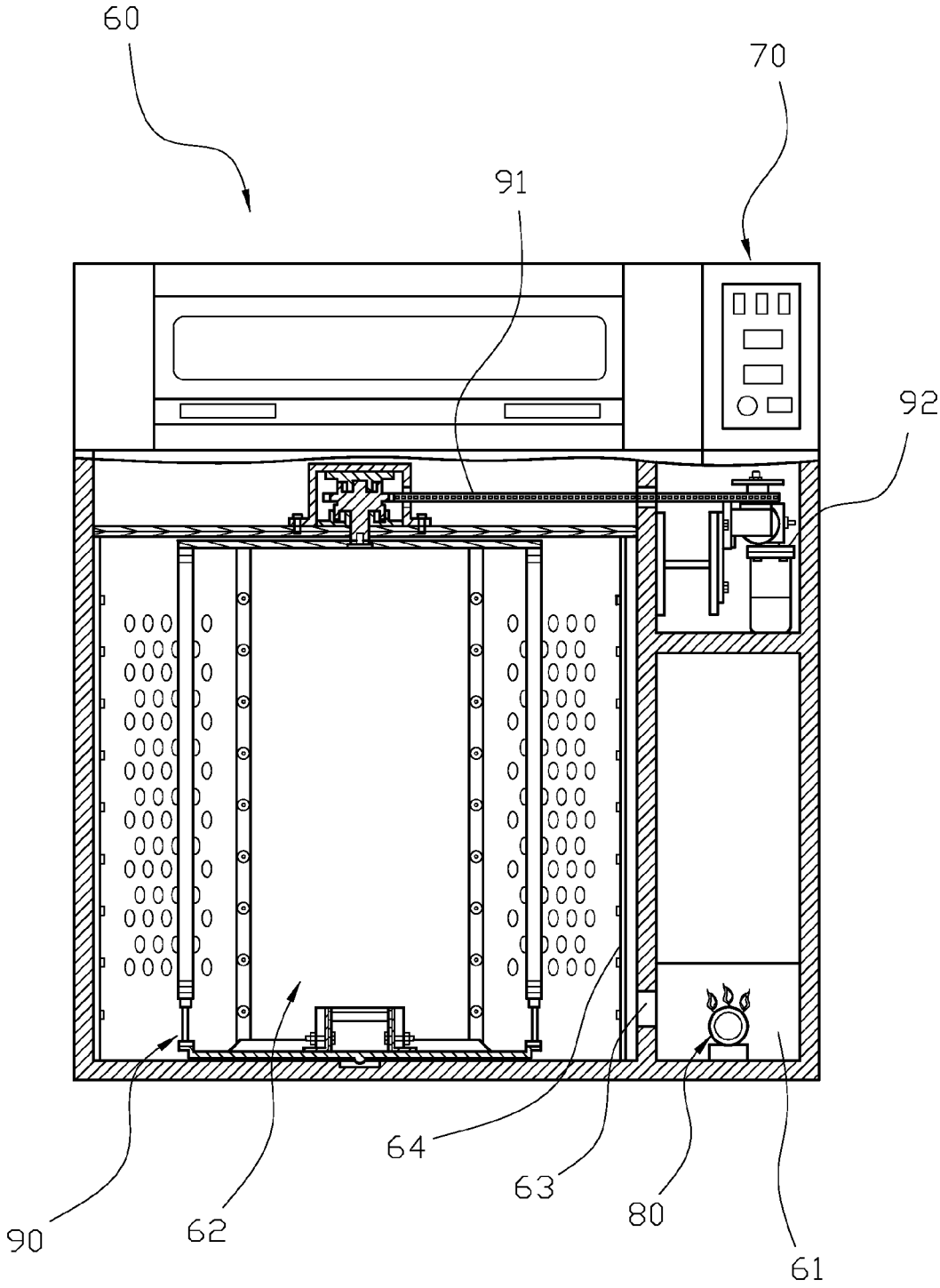
FIG. 10 PRIOR ART
FIG. 10 is a front cross-sectional view of a prior art wood kiln.

Please refer to FIG. 2 and FIG. 3. The controller 50 can be used for setting the rotation speed of the fan set 21 of the diversion device 20 and the heating temperature of the heating device 30; with the containment space 101, the cycled thermal air is provided to the electric wood kiln 100. Furthermore, the controller 50 receives the temperature signals from the temperature sensing units 51 to determine the heating state of the electric wood kiln 100. If the temperature distribution in the containment space 101 is not even, as shown in FIGS. 8 and 9, the controller 50 is capable of controlling the respective adjustable knob 40 to rotate the rotation plate 41 such that the push rod 42 drives the adjusting sheet 43 to guide the heated air from the heating device 30 along different flowing angles, which can improve the temperature distribution in the electric wood kiln 100.

Although the present invention has been explained in relation to its preferred embodiment, it is to be understood that many other possible modifications and variations can be made without departing from the spirit and scope of the invention as hereinafter claimed.

What is claimed is:

1. An electric wood kiln having a containment space, the containment space capable of being sealed by at least one door, the door and an opposite rear sidewall both being attached to at least one aeration panel to form at least one cycling channel, the electric wood kiln respectively having at least one ventilation panel on two facing side walls to form at least one diversion channel; wherein a tray is disposed on a bottom base of the electric wood kiln and in the containment space;

a diversion device is disposed on a top side of the electric wood kiln, the diversion device comprising a fan set, a plurality of diversion fins, at least one counterflow space and at least one intake aperture, the fan set having a plurality of fan blades fluidly connected to the counterflow space, the counterflow space fluidly connected to the cycling channel on the door and the rear sidewall, an outer region of each fan blade fluidly coupling with a plurality of radial diversion fins; the diversion fins and the counterflow space forming fluidly separated spaces coupled via the fan blades, and the intake aperture is connected between the outside of the electric wood kiln and the counterflow space;

a heating device is disposed on a top side of the electric wood kiln adjacent to an outer side of the diversion fins and fluidly connected to the fan set;

an adjustable knob is respectively disposed on at least two facing sidewalls of the electric wood kiln; and a controller is disposed external to the electric wood kiln and capable of electrically connecting the tray, the fan set, the heating device and the adjustable knob.

2. The electric wood kiln as claimed in claim 1, wherein each adjustable knob further comprises a rotation plate and a push rod extending into the diversion channel, one end of the push rod is pivoted onto one end of an adjusting sheet disposed along a middle position of the diversion channel.

3. The electric wood kiln as claimed in claim 1, wherein the controller is electrically connected to a plurality of temperature sensing units, and the temperature sensing units are respectively disposed in the electric wood kiln and used for sensing a temperature of each corner of the electric wood kiln.

4. The electric wood kiln as claimed in claim 1, wherein the heating device is connected to at least one ventilating pipe venting out of the electric wood kiln, which is used for improving a ventilation cycle and to provide cooling for the heating device.

5. The electric wood kiln as claimed in claim 1, wherein the heating device utilizes a heating element secured in a ceramic rod.

* * * * *